US009089963B2

(12) United States Patent
Freimuth

(10) Patent No.: US 9,089,963 B2
(45) Date of Patent: Jul. 28, 2015

(54) TOOL CABINET WITH DOWNWARD OPENING TRANSPARENT FRONT DOOR

(71) Applicant: Versatility Tool Works & Manufacturing Company, Alsip, IL (US)

(72) Inventor: Edward Karl Freimuth, Palos Heights, IL (US)

( * ) Notice: Subject to any disclaimer, the term of this patent is extended or adjusted under 35 U.S.C. 154(b) by 0 days.

(21) Appl. No.: 14/257,771

(22) Filed: Apr. 21, 2014

(65) Prior Publication Data

US 2014/0225485 A1 Aug. 14, 2014

Related U.S. Application Data

(63) Continuation-in-part of application No. 12/272,491, filed on Nov. 17, 2008, now Pat. No. 8,696,074, and a continuation-in-part of application No. 14/075,591, filed on Nov. 8, 2013, now Pat. No. 8,870,308.

(60) Provisional application No. 61/904,485, filed on Nov. 15, 2013, provisional application No. 61/904,491, filed on Nov. 15, 2013.

(51) Int. Cl.

| | |
|---|---|
| ***A47B 88/22*** | (2006.01) |
| ***B25H 3/00*** | (2006.01) |
| ***A47B 81/00*** | (2006.01) |
| ***B25H 1/12*** | (2006.01) |
| ***A47F 3/00*** | (2006.01) |
| ***E05B 65/46*** | (2006.01) |
| ***E05B 65/00*** | (2006.01) |

(52) U.S. Cl.

CPC ..... *B25H 3/006* (2013.01); *A47B 81/00* (2013.01); *A47F 3/005* (2013.01); *B25H 1/12* (2013.01); *E05B 65/0021* (2013.01); *E05B 65/462* (2013.01); *E05B 65/464* (2013.01); *Y10T 29/49826* (2015.01)

(58) Field of Classification Search

CPC ..... E06B 9/115; E06B 3/482; A47B 96/00; A47B 88/0044; A47B 2088/0074; A47B 88/0055; A47F 3/043; A47F 3/0434; E05Y 2900/202

USPC ..... 312/297, 139.2, 209

See application file for complete search history.

(56) References Cited

U.S. PATENT DOCUMENTS

| | | | | | |
|---|---|---|---|---|---|
| 721,403 | A | * | 2/1903 | Wege | 312/297 |
| 1,159,859 | A | * | 11/1915 | Carlson | 160/33 |
| 1,231,233 | A | * | 6/1917 | Bertram | 160/33 |

(Continued)

FOREIGN PATENT DOCUMENTS

| | | | |
|---|---|---|---|
| DE | 10236212 | * | 2/2004 |
| EP | 1516997 | * | 3/2005 |

*Primary Examiner* — Janet M Wilkens

(74) *Attorney, Agent, or Firm* — Joseph Golant

(57) ABSTRACT

A press brake tool cabinet with a downward opening transparent door. The door included a number of rectangular polycarbonate slats in frame members. The cabinet included a frame assembly and a number of drawers. Left and right door track systems are connected to the cabinet, and the door moves from an upper closed position in front of the drawers to an open position beneath and behind the drawers. Stop plates defined the position of the door in the open position and hanger plates supported and retained the door in the upper closed position. A pulley system facilitated movement of the door and a lock system maintained the door in the closed position.

14 Claims, 11 Drawing Sheets

(56) References Cited

U.S. PATENT DOCUMENTS

| | | | | | |
|---|---|---|---|---|---|
| 1,423,078 | A | * | 7/1922 | Carlson | 312/348.3 |
| 2,201,696 | A | * | 5/1940 | Lucas | 62/249 |
| 2,231,005 | A | * | 2/1941 | Gordon | 312/260 |
| 2,236,870 | A | * | 4/1941 | Derman | 312/260 |
| 2,498,562 | A | * | 2/1950 | Long | 62/246 |
| 2,585,136 | A | * | 2/1952 | Kuchler | 160/36 |
| 2,766,822 | A | * | 10/1956 | Potter | 160/201 |
| 3,266,858 | A | * | 8/1966 | Klotz | 312/270.3 |
| 3,712,697 | A | * | 1/1973 | Kelley et al. | 312/297 |
| 3,837,041 | A | * | 9/1974 | Modert et al. | 16/94 R |
| 4,279,454 | A | * | 7/1981 | Koiso et al. | 312/297 |
| 4,408,346 | A | * | 10/1983 | Bauer | 455/175.1 |
| 4,421,364 | A | * | 12/1983 | Takaniemi | 312/35 |
| 4,588,237 | A | * | 5/1986 | Marder | 312/209 |
| 4,854,632 | A | * | 8/1989 | Kreuze et al. | 296/37.12 |
| 4,962,649 | A | * | 10/1990 | Battocletti | 62/256 |
| 5,193,726 | A | * | 3/1993 | Humphrey | 225/4 |
| 5,301,092 | A | * | 4/1994 | Santosuosso et al. | 362/125 |
| 5,507,335 | A | * | 4/1996 | Yu | 160/235 |
| 5,808,816 | A | * | 9/1998 | Yu | 359/810 |
| 6,358,548 | B1 | * | 3/2002 | Ewald et al. | 426/418 |
| 6,547,350 | B2 | * | 4/2003 | Maritan et al. | 312/408 |
| 8,162,025 | B2 | * | 4/2012 | Motosko et al. | 160/180 |
| 8,579,151 | B2 | * | 11/2013 | Kodama et al. | 220/812 |
| 2002/0043907 | A1 | * | 4/2002 | Picogna | 312/194 |
| 2003/0028588 | A1 | * | 2/2003 | McConnell et al. | 709/203 |
| 2009/0288343 | A1 | * | 11/2009 | Romolo | 49/77.1 |

* cited by examiner

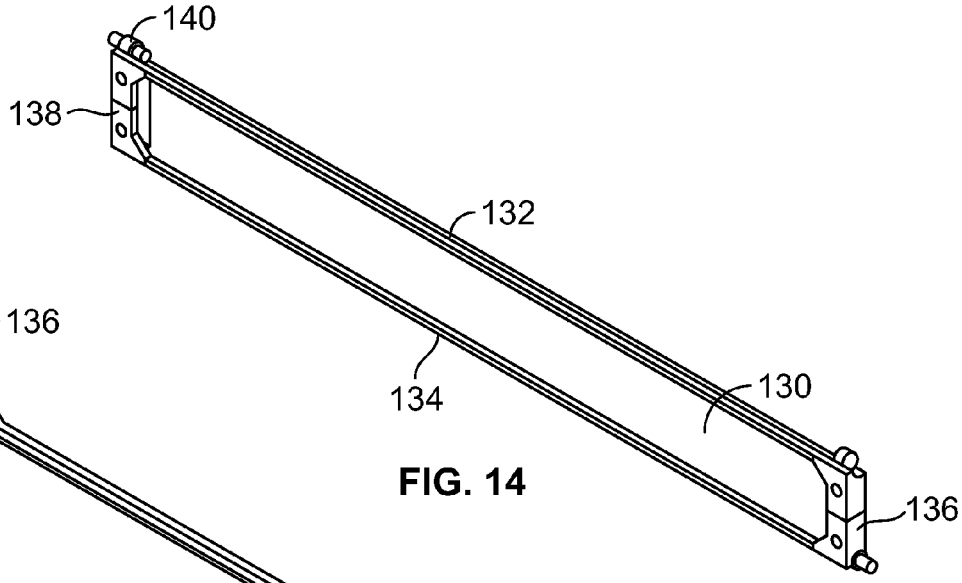
FIG. 14
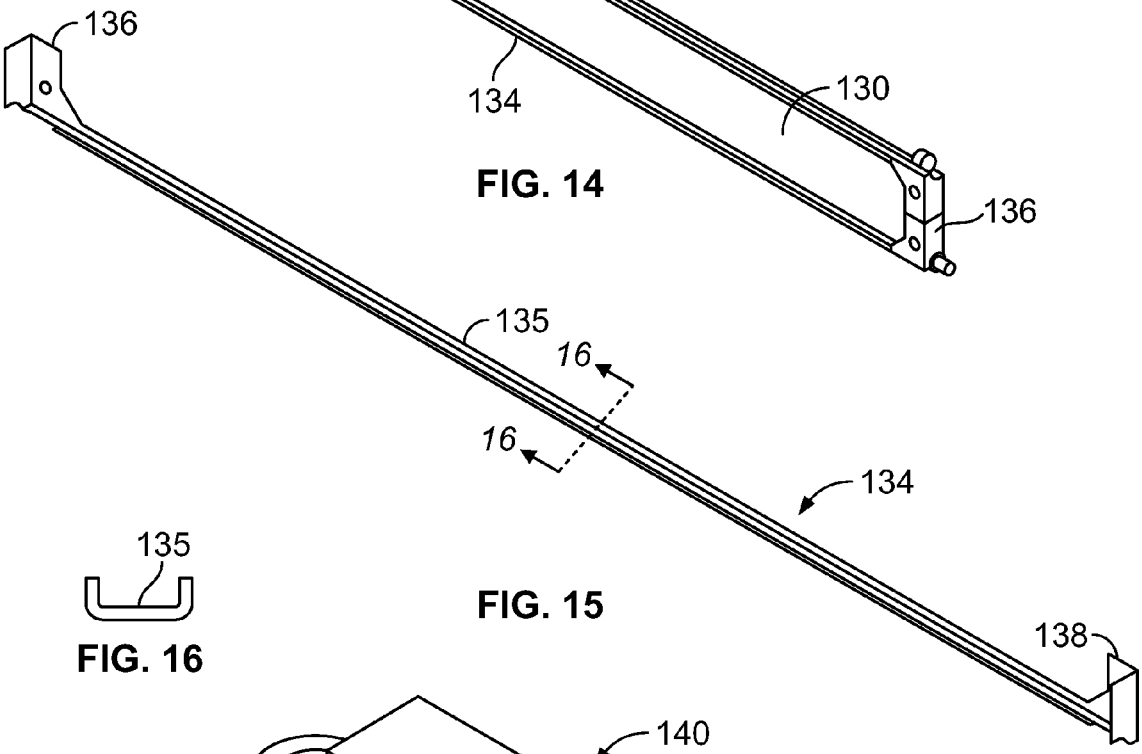
FIG. 15
FIG. 16
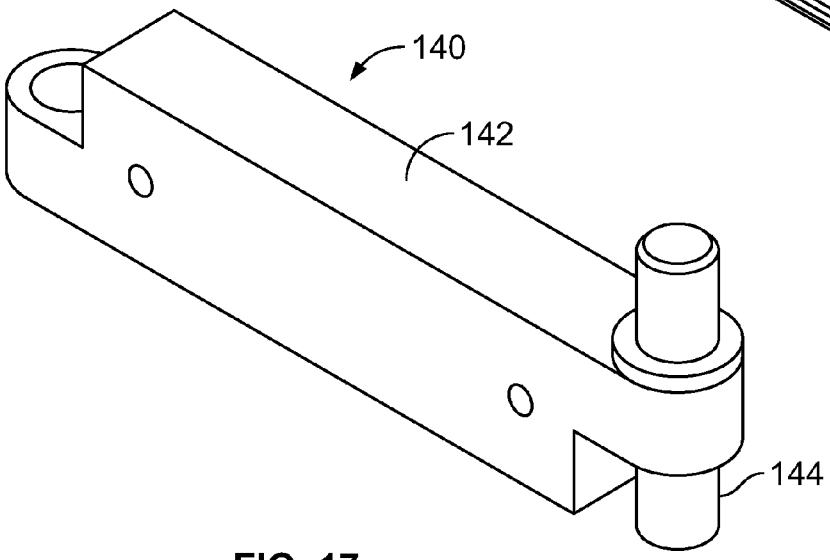
FIG. 17

TOOL CABINET WITH DOWNWARD OPENING TRANSPARENT FRONT DOOR

PRIORITY REFERENCE

This application claims priority pursuant to 35 U.S.C. 120 from U.S. Provisional Application No. 61/904,485 filed Nov. 15, 2013, entitled "Tool Cabinet With Downward Opening Transparent Front Door", U.S. Provisional Application No. 61/904,491 filed Nov. 15, 2013, entitled "Press Brake Tool Cabinet Drawer Having Rotatable Front Panel", U.S. Non-Provisional application Ser. No. 12/272,491, filed on Nov. 17, 2008, entitled "Safety Lock System For Cabinet Drawers," now U.S. Pat. No. 8,696,074, and U.S. Non-Provisional application Ser. No. 14/075,591, filed on Nov. 8, 2013, entitled "Universal Safety Lock System For Tool Cabinets" which are all expressly incorporated herein by these references.

FIELD OF THE INVENTION

The present invention relates generally to a press brake tool cabinet and, more particularly, to a press brake tool cabinet having a downward opening transparent front door that allows a user to quickly locate press brake tools stored in drawers of the cabinet without first opening the door.

BACKGROUND OF THE INVENTION

A press brake is a machine tool for bending sheet and plate material. The machine tool forms predetermined bends by clamping a work piece between matching punch and die tools. The tools are heavy and bulky and are typically stored in cabinets. Changing dies is a time consuming and difficult task so that making the process easier and more efficient is desirable. Typical press brake tool cabinets consist of a cabinet shell with non-transparent steel drawers so that the contents of each drawer is unknown except to the extent an operator remembers the location of specific tools.

The invention discussed in connection with the described embodiments below address deficiencies of the press brake tool cabinet field. The features and advantages of the present invention will be explained in or become apparent from the following summary and detailed description of the preferred embodiment considered together with the accompanying drawings.

SUMMARY OF THE INVENTION

The tool cabinet of the present invention allows for quick, easy and efficient tool selections by a user, and does so with a cabinet that is compact and robust. The tool cabinet described in detail below is relatively low cost, safe, easy to use, aesthetically pleasing in appearance and relatively easy to manufacture and assemble.

Briefly summarized the invention relates to a press brake tool cabinet including a cabinet with a plurality of extendable drawers, two side panels and a rear panel, left and right track systems mounted to the cabinet in front of the drawers, and a transparent door mounted to the left and right track systems in front of the drawers, the door being movable between an upper closed position and a lowered open position.

The invention also relates to a method for assembling a press brake tool cabinet including the steps of constructing a frame assembly having a front and a rear, attaching left and right cabinet door track systems to the frame assembly, forming a cabinet door of transparent polycarbonate slats, and mounting the cabinet door to the left and right track systems to allow movement of the cabinet door between an upward closed position and a downward open position.

BRIEF DESCRIPTION OF THE DRAWINGS

For the purpose of facilitating an understanding of the invention, the accompanying drawings and detailed description illustrate the preferred embodiments thereof, from which the invention, its structures, its construction and operation, its processes, and many related advantages may be readily understood and appreciated.

FIG. 14 is an isometric view of the door slat with upper and lower slat frame members and hinge brackets.

FIG. 15 is an enlarged isometric view of a frame member illustrated in FIG. 14.

FIG. 16 is an enlarged sectional view taken along line 16-16 of FIG. 15.

FIG. 17 is an enlarged isometric view of the hinge bracket with a guide pin.

DESCRIPTION OF THE PREFERRED EMBODIMENTS

Figure 1:
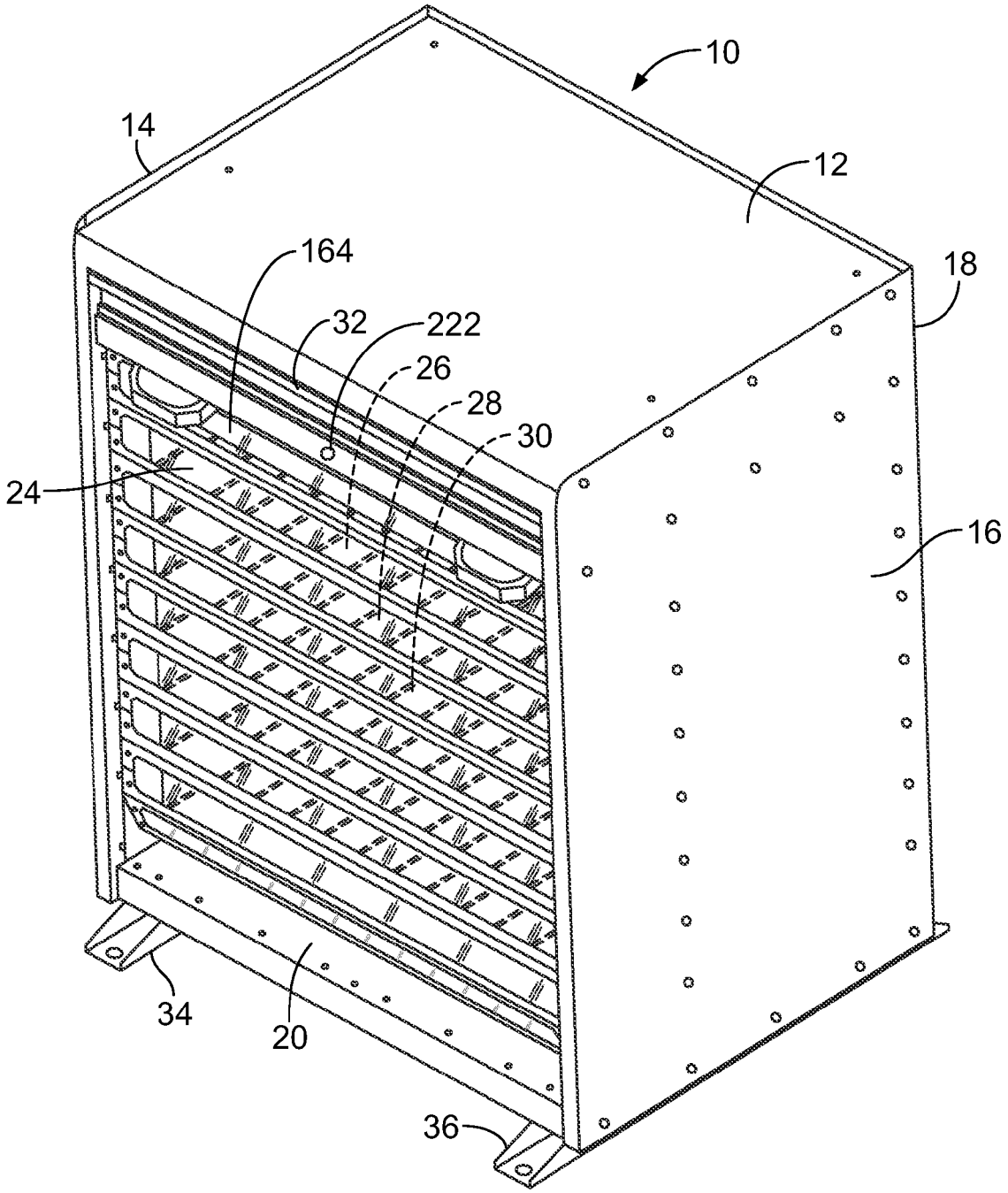
FIG. 1 is an isometric view of a tool cabinet with a downward opening transparent cabinet door illustrated the cabinet door in an upward closed position.

The following description is provided to enable those skilled in the art to make and use the described embodiments set forth in the best mode contemplated for carrying out the invention. Various modifications, equivalents, variations, and alternatives, however, will remain readily apparent to those skilled in the art. Any and all such modifications, variations, equivalents, and alternatives are intended to fall within the spirit and scope of the present invention.

Referring now to FIGS. 1-3, and 23, there is illustrated a preferred embodiment of a press brake tool cabinet 10. The tool cabinet 10 includes a top panel 12, two side panels 14, 16, a rear panel 18, and a bottom panel 20. A transparent downward opening cabinet door 24 is mounted at the front of the cabinet. Behind the door 24 are a plurality of tool receiving extendible drawers, such as the drawers 26, 28, 30. Positioned above the closed door 24, FIG. 1, and below the top panel 12 is a utility drawer 32 for accessories, such as measuring instruments, for example. The press brake tool cabinet 10 may include two support brackets 34, 36 that may be used to mount the tool cabinet 10 to a factory or shop floor. The door 24 is movable between a closed upward position illustrated in FIG. 1, and a downward open position illustrated in FIG. 2. The door 24 is illustrated in a partially open position in FIG. 3.

Figure 5:
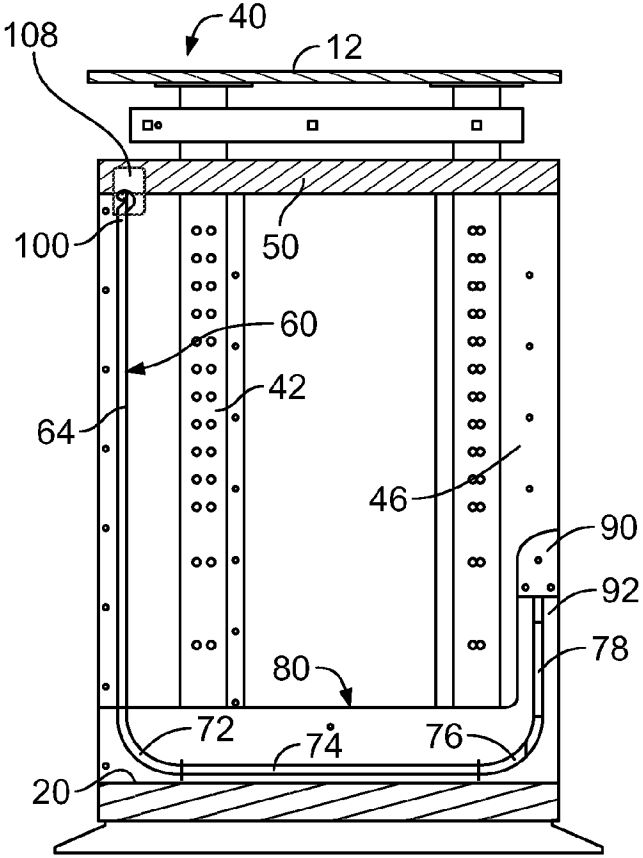
FIG. 5 is a sectional elevation view taken along line 5-5 of FIG. 4.
Figure 4:
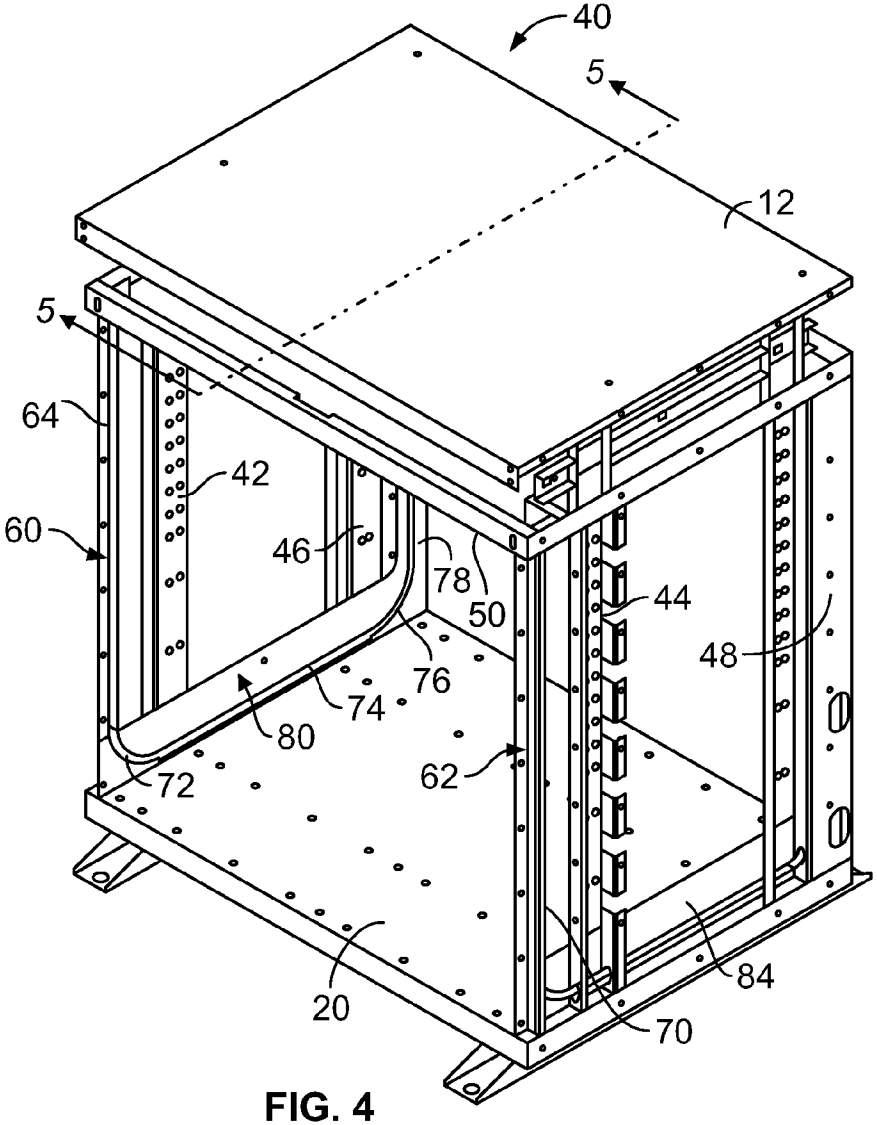
FIG. 4 is an isometric view of a frame assembly of the tool cabinet illustrated in FIG. 1.

A frame assembly 40, FIGS. 4 and 5, is located under and between the top and side panels 12, 14, 16, respectively, the panels being mounted to the frame assembly. The frame assembly 40 includes left side front frame post 42, a right side front frame post 44, a left side rear frame post 46 and a right side rear frame post 48. The posts 42, 44, 46, 48 are mounted in a vertical orientation between the bottom panel 20 and a spacer panel 50. Left and right track systems 60, 62 are mounted in the frame assembly 40 in front of the front posts 42, 44 and extend to the rear posts 46, 48 to accommodate movement of the door 24 between its closed and open positions.

Figure 6:
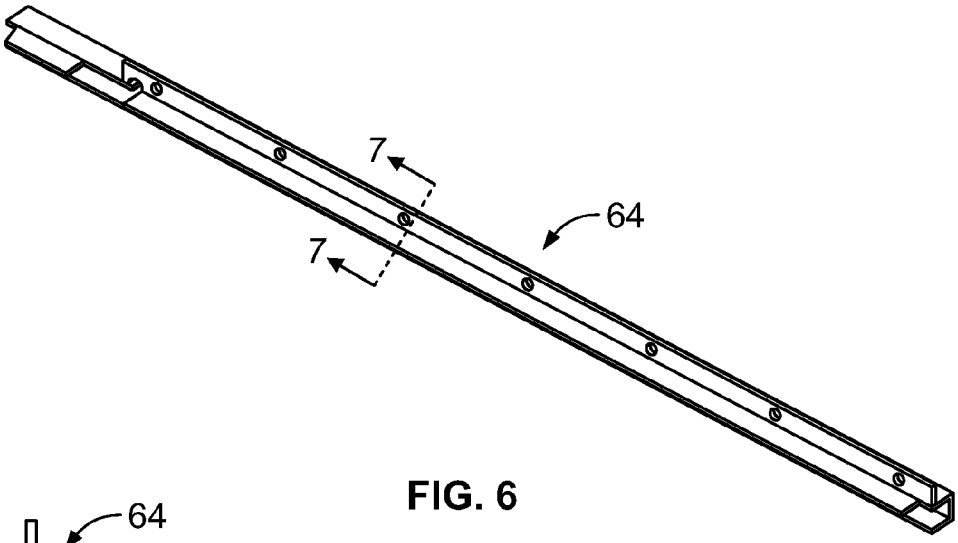
FIG. 6 is an isometric view of a portion of a door track for the cabinet door.
Figure 7:
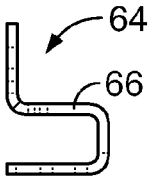
FIG. 7 is an enlarged sectional view taken along line 7-7 of FIG. 6.
Figure 8:
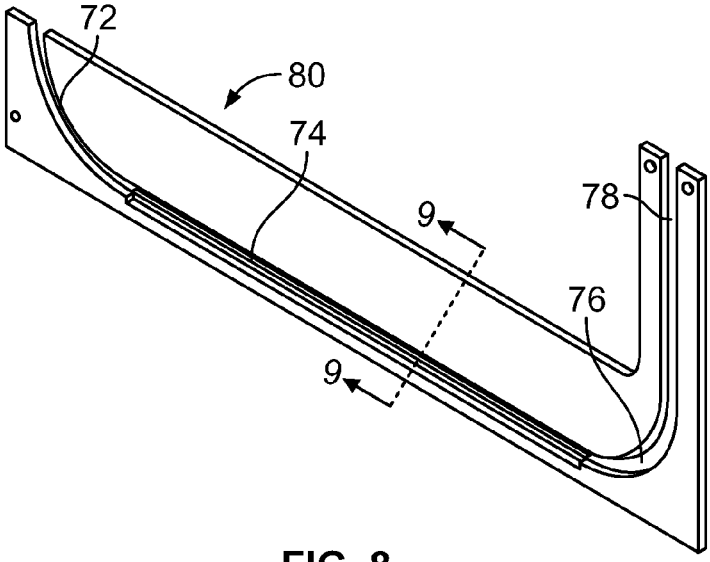
FIG. 8 is an isometric view of a plate having four more portions of the door track.
Figure 9:
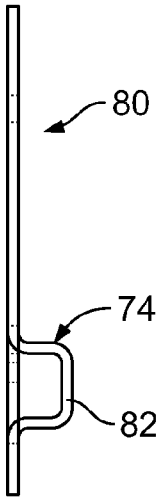
FIG. 9 is an enlarged sectional elevation view taken along line 9-9 of FIG. 8.

The track system 60 includes a left vertically oriented front portion 64, FIGS. 5-7, having a C-shaped channel 66 to guide pins connected to the door as will be explained below. The track system 62 includes a right vertically oriented front portion 70, FIG. 4. The right track system 62 is a mirror image of the left track system 60 so that only the left track system 60 is described here. Adjacent to the left vertically oriented front portion 64 is a first left side curved portion 72, FIGS. 4, 5 and 8, a left horizontal bottom portion 74, a second left side curved portion 76, and a left vertically oriented rear portion 78. The first and second curved portions 72, 76, the horizontal bottom portion 74 and the vertically oriented rear portion 78 are all formed on a single track plate 80, FIG. 8, and together approximate a "J" shape. The first curved portion 72, the second curved portion 76, and the vertically oriented rear portion 78 are formed from cutouts on the plate 80. The horizontal bottom portion 74 is a C-shape channel 82, FIG. 9. A right side track plate 84, FIG. 4, is a mirror image of the left side track plate 80 and has identical corresponding elements as the plate 80. The track systems direct the door movement from a position in front of the drawers, around and beneath the drawers and behind the drawers.

Figure 10:
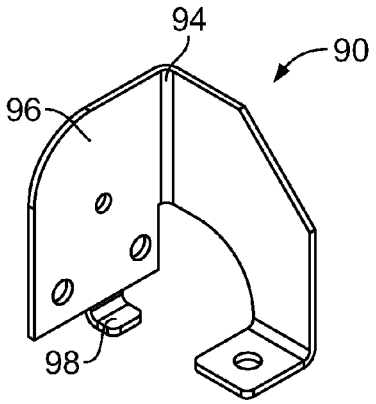
FIG. 10 is an isometric view of a doorstop bracket.
Figure 11:
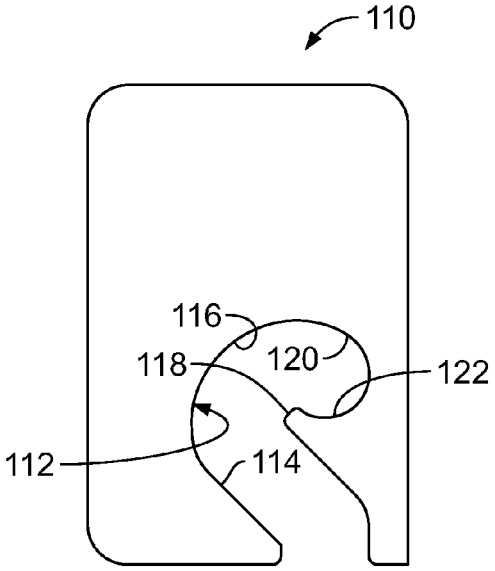
FIG. 11 is a front elevation view of a hanger plate.

Left and right stop brackets, of which only the left stop bracket 90, FIGS. 5 and 10, is shown because the stop brackets are mirror images of each other, are attached to the left and right side rear frame posts 46, 48 at rear terminal ends of the track systems 60, 62, such as the terminal end 92, FIG. 5, of the left track system 60. The stop brackets act to limit movement of the door 24 as it moves downward from its closed position, around the "J" of plates 80, 84, to its open position. The stop bracket 90, FIG. 10, is a right-angled plate 94 with one arm 96 attached to the track system 60 such that a tab 98 blocks the terminal end 92 of the left track system 60. The right stop bracket is a mirror image of the left stop bracket 90 and operates in the same manner. At the front terminal ends of the track systems 60, 62, such as the front terminal end 100, FIG. 5, of the left track system 60, where the door reaches to its closed position, are door hanger plates, such as the left hanger plate 108, FIG. 5, and the right hanger plate 110, FIGS. 11, 23 and 24, to capture and support the door 24 in its closed position. The hanger plate 110, FIG. 11, includes a cutout 112 shaped somewhat like a question mark and acts as a cam to guide pins that act as cam followers.

When the door is moved upward toward its closed position the appropriate pin bears against a first surface 114 tracing a slight upward and rearward path until the pin traces a curved surface 116, reversing the movement of the pin while passing around a protruding lip 118, to a curved surface 120 where the pin moves forward and slightly downward into a trough 122. The trough 122 captures the pin, and the lip 118 guards against the pin from slipping out and allowing inadvertent downward movement of the door. The pins are attached to the door so that when the pins are captured they will support the door in its closed position. The right hanger plate is identical to the left hanger plate and operates in the same manner.

Figure 12:
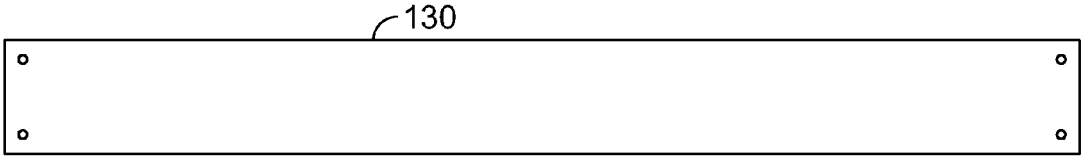
FIG. 12 is a front elevation view of a transparent door slat.
Figure 13:
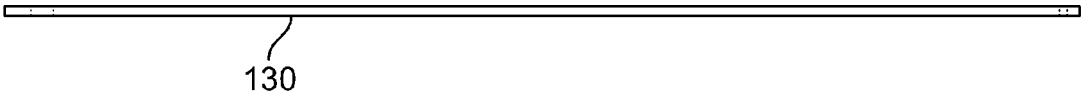
FIG. 13 is a bottom plan view of the transparent door slat illustrated in FIG. 12.
Figure 18:
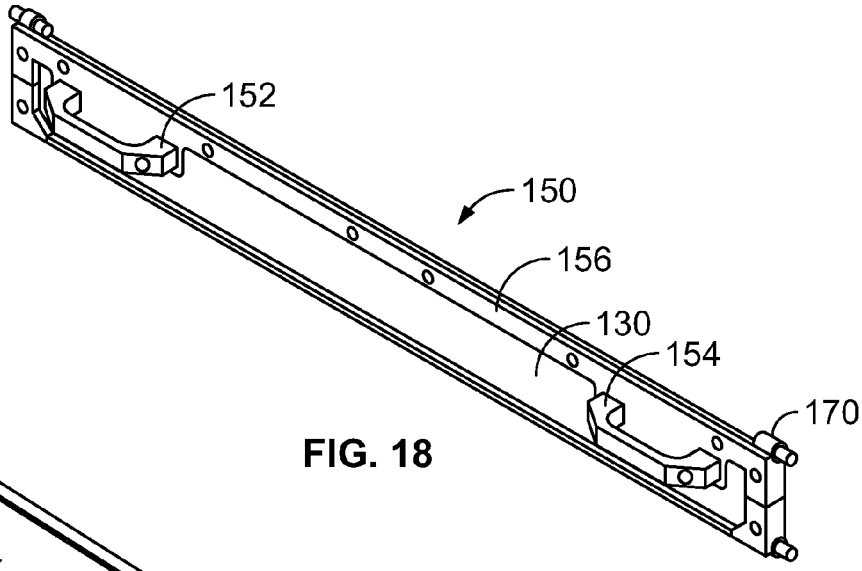
FIG. 18 is an isometric view of an upper most slat, upper and lower frame members and hinge brackets, where the upper frame member includes handles.
Figure 19:
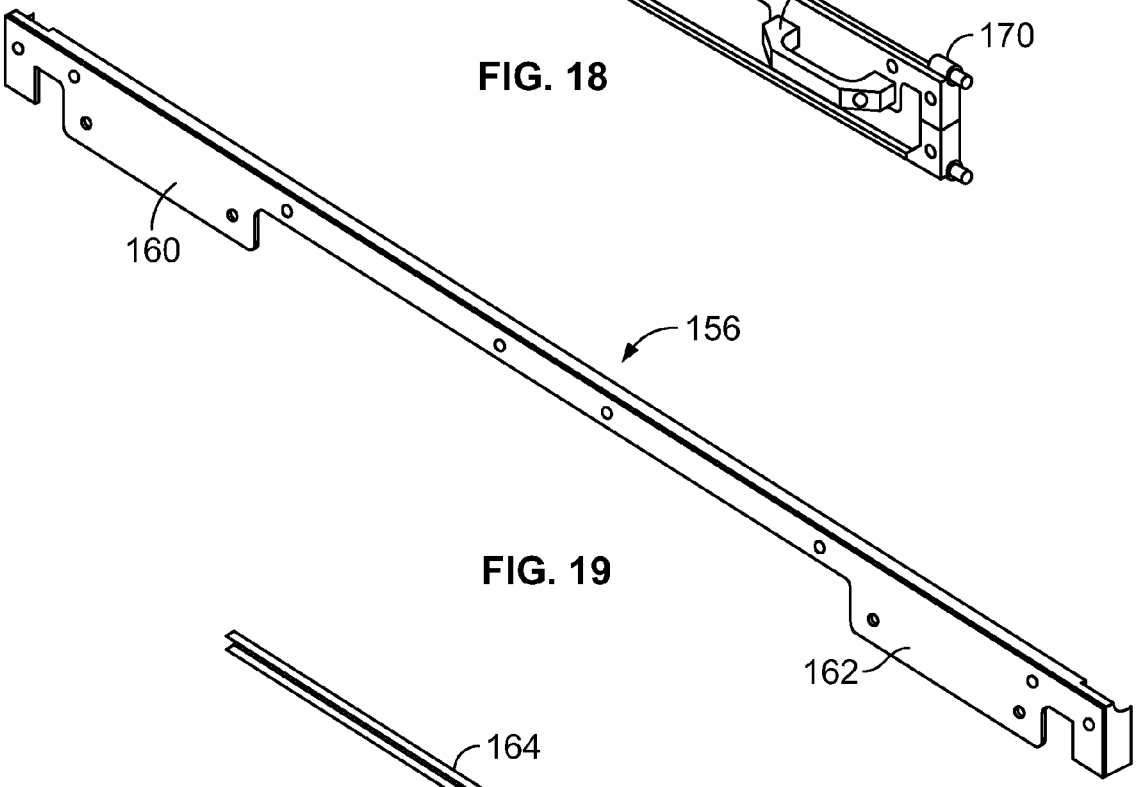
FIG. 19 is an enlarged isometric view of the upper frame member shown in FIG. 18 with the handles.
Figure 20:
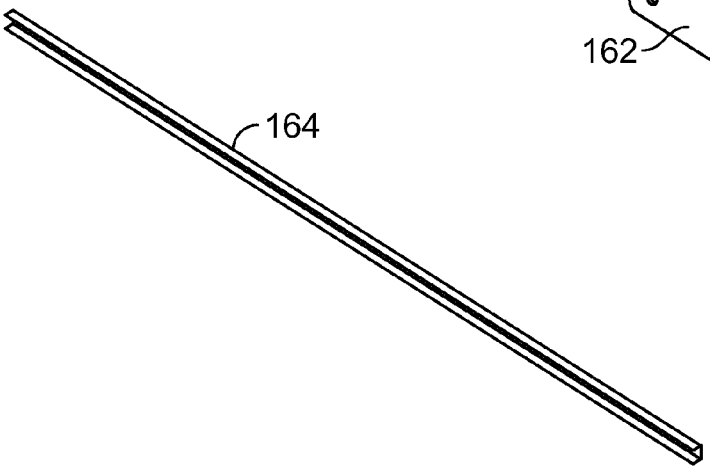
FIG. 20 is an enlarged isometric view of a channel support brace for the upper most slat and frame members.
Figure 21:
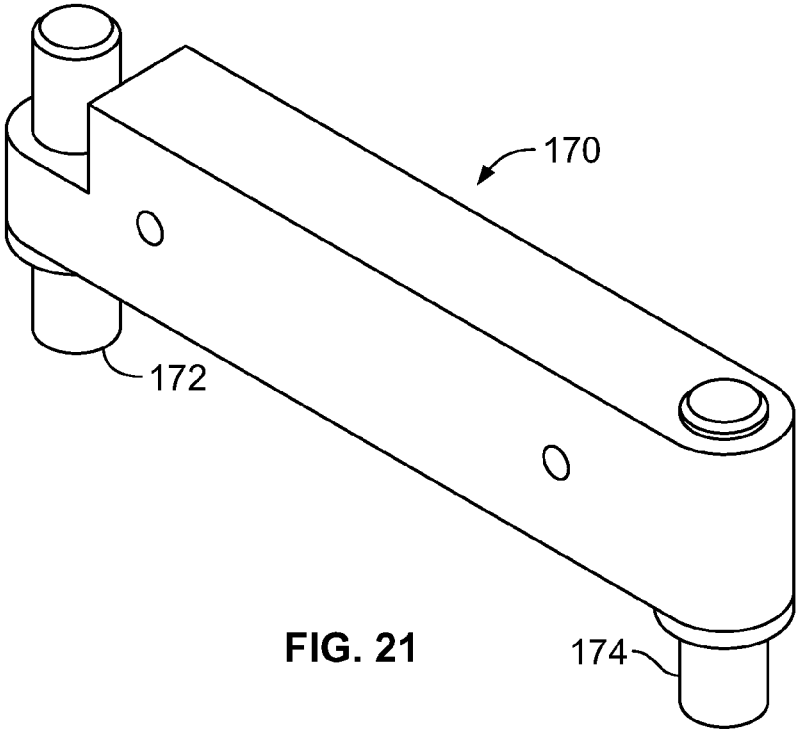
FIG. 21 is an enlarged isometric view of a hinge bracket with two guide pins.
Figure 22:
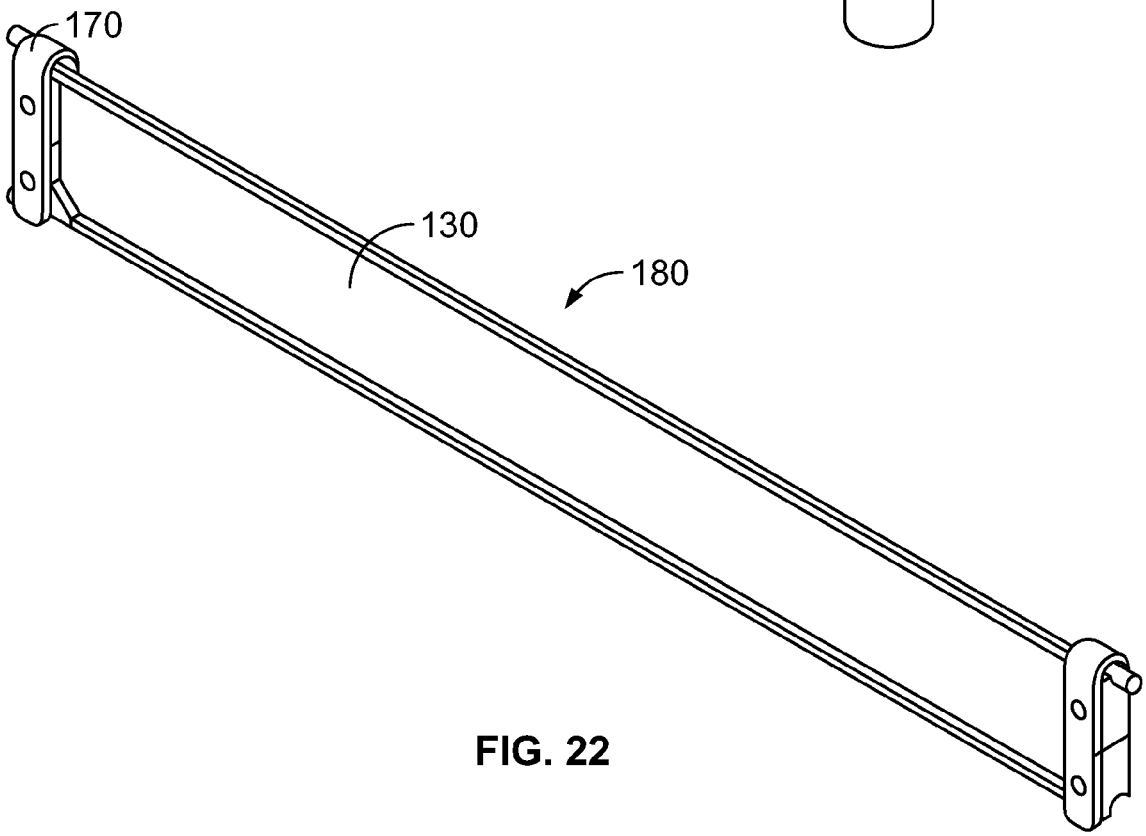
FIG. 22 is an isometric view of the lower most slat, upper and lower frame members and hinge brackets.

The door 24 is formed of transparent polycarbonate slats, such as the rectangular slat 130, FIGS. 12 and 13. Identical upper and lower slat frame members 132, 134, FIG. 14, surround each of the slats, except for the upper most slat. The slat frame 134 is illustrated by itself in FIG. 15, has a mid portion 135 with a C-shaped channel in cross section, as shown in FIG. 16, and connection flanges 136, 138. The slat frame 132 is identical to the slat frame 134 but oriented upside down. The connection flanges 136, 138 of each frame member are fastened with hinge brackets, such the hinge bracket 140, FIGS. 14 and 17. Each hinge bracket 140 includes a nylon bar 142, FIG. 17, and projecting guide pins, such as the guide pin 144. The guide pins are what move in the hanger brackets, such as the right hanger bracket 110, FIG. 11, what move in the track systems and with the hinge brackets what connect the slats and the frame members together. The upper most slat, frame member and hinge bracket combination 150, FIG. 18, includes handles 152, 154 for facilitating lowering and raising the cabinet door 24. The upper most combination 150 includes a stronger upper frame member 156, FIGS. 18 and 19, has handle tabs 160, 162 and combines with a channel shaped back support brace 164, FIG. 20, which is shown in shadow in FIG. 1. Illustrated in FIG. 21 is a slight different hinge bracket 170, FIG. 21 having opposing guide pins 172, 174. The bottom most slat 180, FIG. 22, includes the double pin hinge bracket 170.

Figure 2:
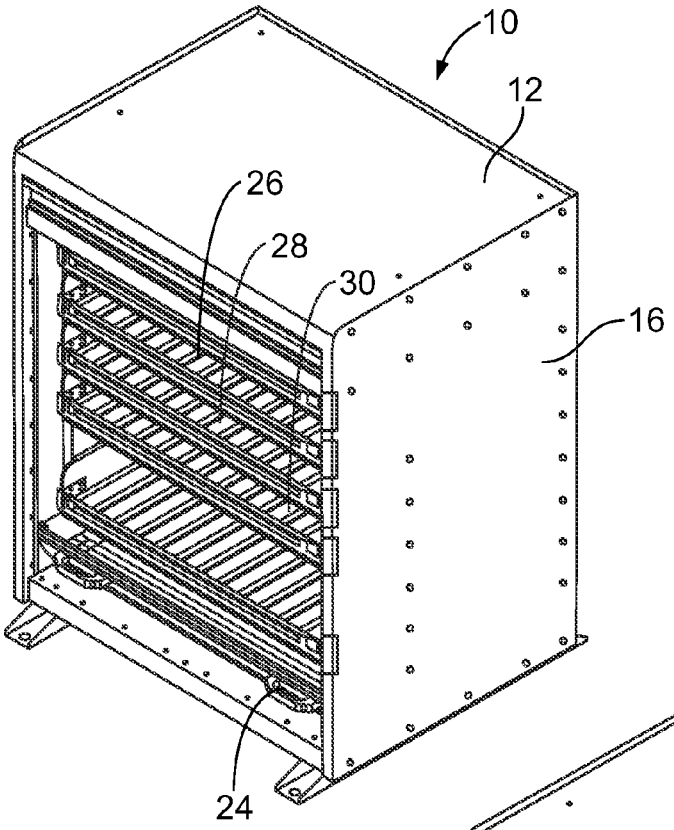
FIG. 2 is a reduced isometric view of the tool cabinet illustrated in FIG. 1, with the cabinet door in a downward open position.
Figure 3:
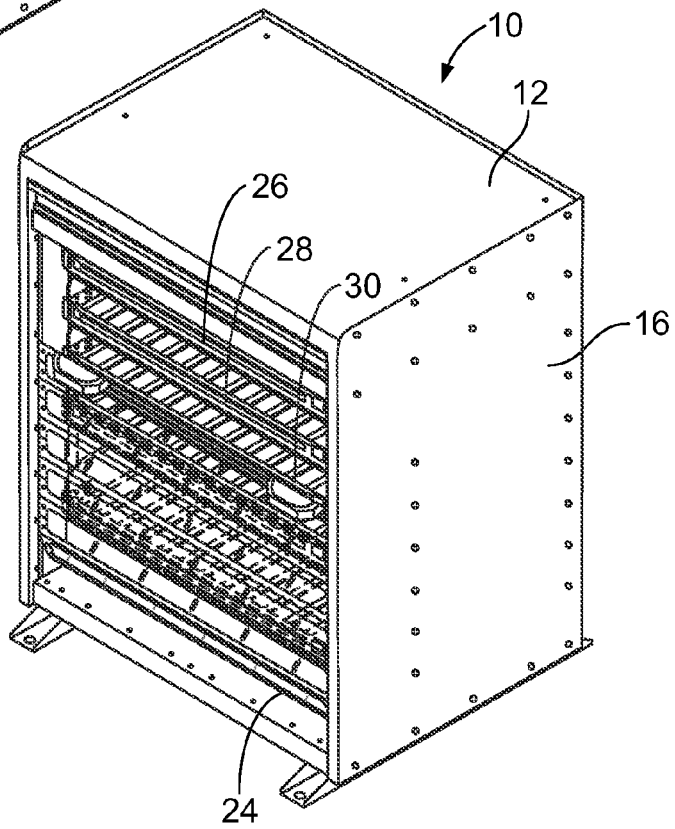
FIG. 3 is a reduced isometric view of the tool cabinet illustrated in FIG. 1, with the cabinet door in a partially open position.

The door is movable between an upper or closed position illustrated in FIG. 1 and an open position illustrated in FIG. 2. It is noted that the cabinet door 24 moves downward to open and upward to close, an important safety feature. The downward-to-open movement of the door prevents the door from accidently falling on a user as garage doors sometimes do. Should a door inadvertently fall, it will move downward around the track systems 60, 62 inside the cabinet until the stop brackets arrest the door's movement. See for example the stop bracket 90, FIGS. 5 and 10. Two pulley systems 190, 192, FIG. 23, may be connected to the door 24 to control and balance the door's movement. The right side pulley system 192 may include a support bracket 194, two pulleys 196, 198 mounted to the support bracket 194, and a constant torque spring motor assembly 200. Such a motor assembly may be acquired from Ametek Hunter Spring of Feasterville, Pa. A cable 202 extends from the motor assembly 200 around the pulleys 196, 198 and attaches to the door 24. The left side pulley system 190 is a mirror image of the pulley system 192, includes the same elements, and operates in the same manner.

As mentioned, each rectangular slat is preferably formed of transparent polycarbonate. A major advantage of using a strong transparent material such as polycarbonate is that a user of the tool cabinet is able to view the press brake tools in the drawers without the time wasting requirement of opening the drawers. The term "transparent" is used here to mean that there is little diffusion or distortion of light so that the user is able to make out the shape of press brake tools by visual inspection through a closed door. The strength of polycarbonate is useful in factory and shop environments because of the large and heavy tools and work pieces being moved about. To help view the interior of the tool cabinet, a light 210, FIG. 23, may be mounted near a reflector 212 to the rear panel 18 of the cabinet 10. The light may also give the interior of the tool cabinet a pleasing and high tech appearance.

In the alternative, the door may be formed from more or less slats than illustrated in the drawings, or may ever be formed from a single sheet of flexible, transparent material with appropriate frame members and track systems. Also, other transparent materials may be used for the door, if desired.

Figure 24:
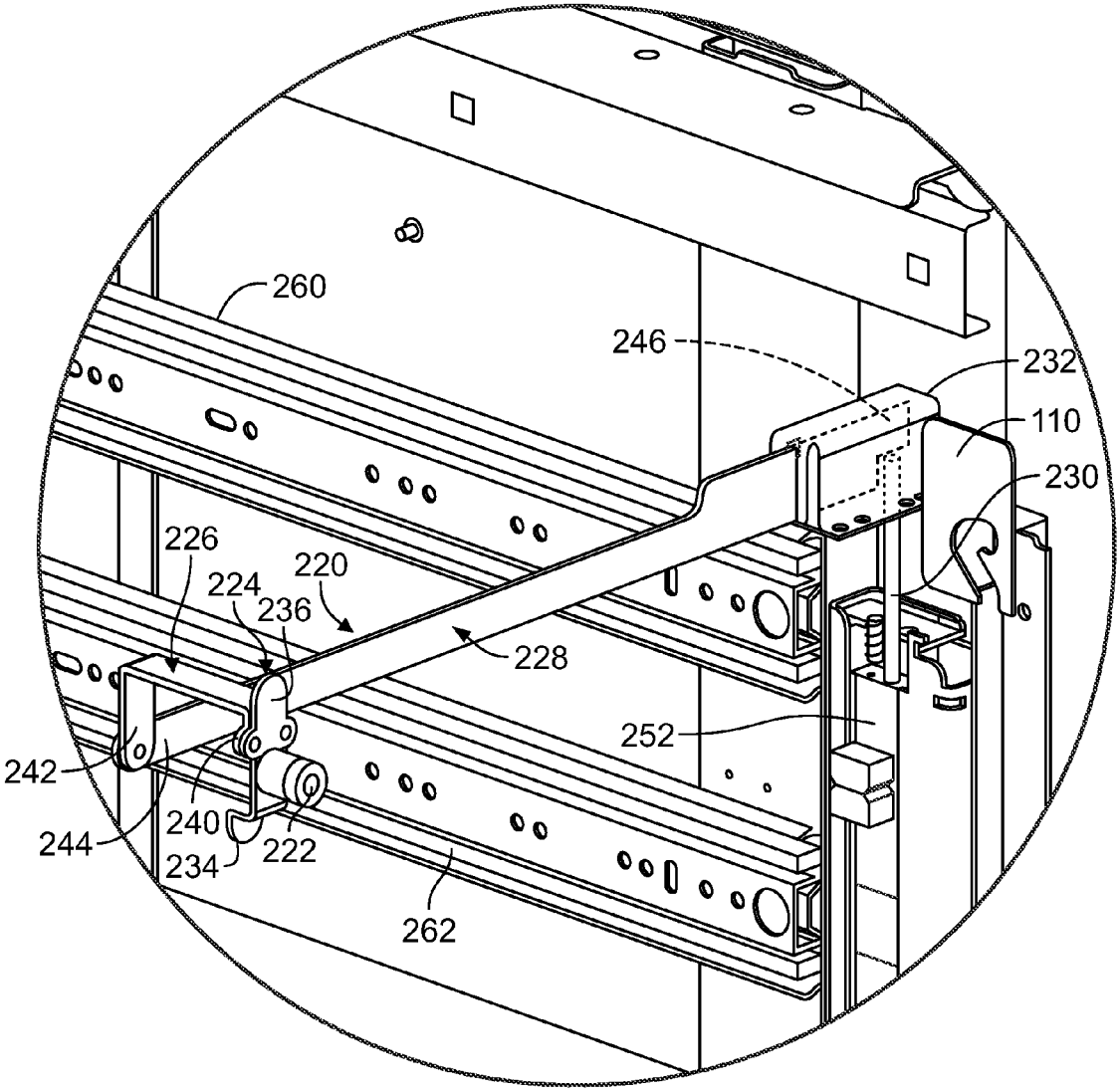
FIG. 24 is an enlarged isometric view of the lock system and drawer slides taken within circle 24-24 of FIG. 23.

A three-in-one lock system 220, FIG. 24, may also be provided for security purposes. The lock system is mounted to the cabinet and includes a key cylinder 222, a first pivotal link 224, a second pivotal link 226, an elongated link 228, a rod 230 and a cover bracket 232. The first pivotal link 224 is attached to the key cylinder 222 so that the first pivotal link 224 pivots when a key is rotated in the key cylinder. At a lower end of the first pivotal link 224 is a lower tab 234 for locking the door 24. At an upper end of the first pivotal link 224 is an upper tab 236 that is used to lock the utility drawer 32, FIG. 1. Below the upper tab 236 the first pivotal link 224 is fixed to a front tab 240 of the second pivotal link 226 to cause the second pivotal link to also pivot when the key rotates in the key cylinder 222. A rear tab 242 of the second pivotal tab 226 is pivotally connected to an inner end 244 of the elongated link 228 such that when the second pivotal link 226 pivots the elongated link 228 moves parallel to the door 24 of the cabinet. An outer end 246 of the elongated link 228 makes or breaks contact with the top of the rod 230 when the elongated link 228 is translated. When the elongated link 228 is in contact with the rod 230 to lock the cabinet, as shown, the elongated link 228 is sandwiched between the cover bracket 232 and the rod, and the rod 230 bears against a top lock block 252 of a stack of lock blocks. The stack of lock blocks is unable to move vertically as explained in the earlier mentioned patent application Ser. No. 12/272,491, and that means that the drawers of the cabinet are prevented from opening. The cover bracket 232 prevents the elongated link 228 and the rod 230 from upward movement when they are in contact. When the elongated link 228 slides away from the rod 230 the lock blocks may move sufficiently to allow one of the drawers to be opened while the cover bracket 232 maintains an upper limit to movement of the rod 230.

Figure 23:
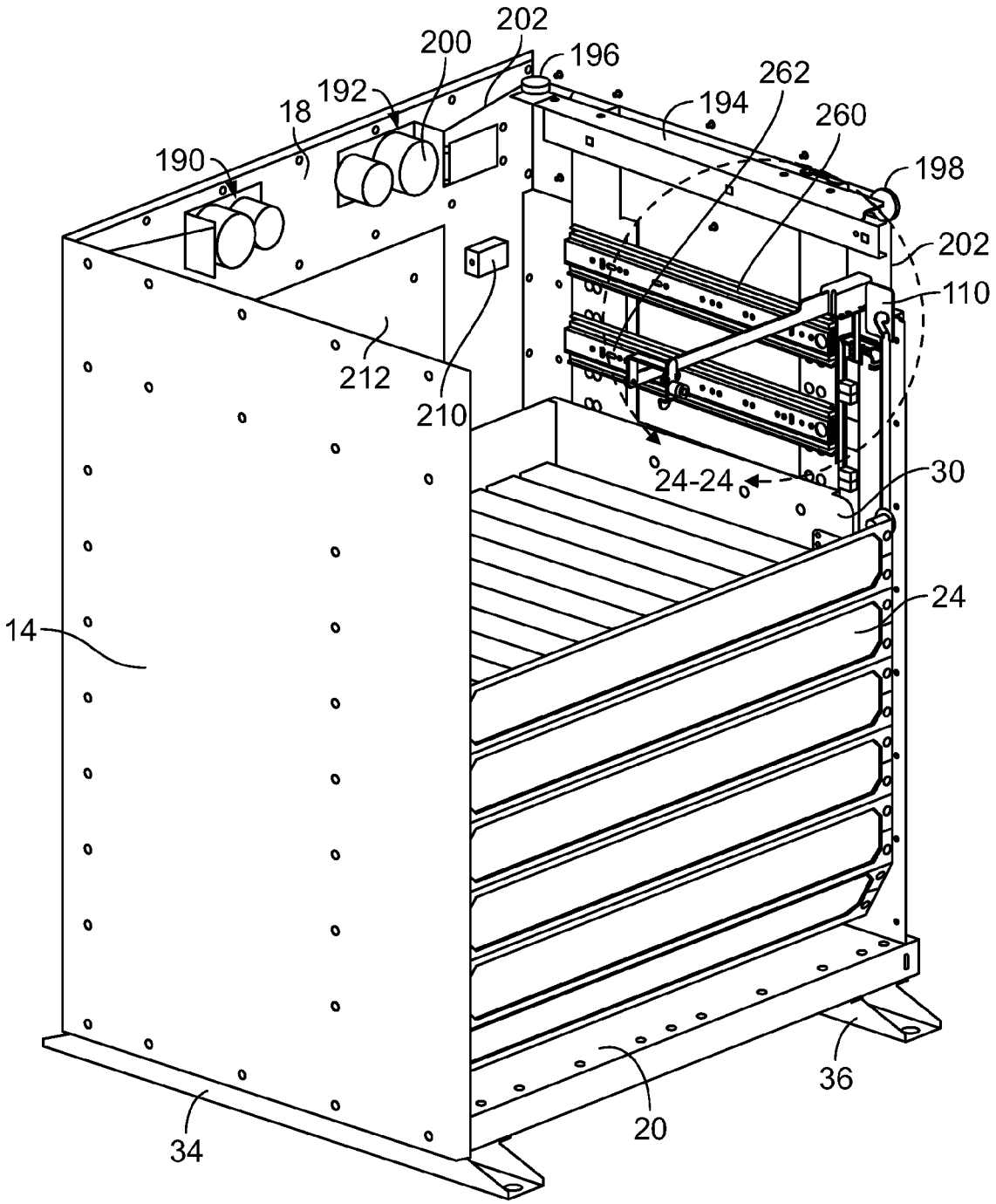
FIG. 23 is an isometric view of the cabinet with a portion of the cabinet door, two drawers and a top panel removed to illustrate a lock system, two pulley systems, an interior light, a reflector and two drawer slides.

Two drawer slides 260, 262, FIGS. 23 and 24, are mounted to the frame assembly 40 and the two drawers 26, 28. Each of the drawers is mounted to one or two pairs of drawer slides depending upon the drawer size and/or load capacity. Suitable drawer slides may be acquired from ACCURIDE of Santa Fe Springs, Calif., model number 9308.

It is noted that throughout this detailed disclosure, words such as "upper," "lower," "top," "bottom," "front," and "rear," as well as like terms, refer to portions of the press brake tool cabinet and its structures and elements as they are viewed in the drawings relative to other structures, elements or portions, or in relationship to the positions of the structures, elements and portions as they will typically be positioned in the finished cabinet when in use.

In operation of the downward opening, transparent front cabinet door 24, a user desiring to remove a press brake tool from the cabinet makes a visual inspection through the door to locate the position of the desired tool in one of drawers. This may be done without unlocking and/or opening the door. Allowing visual inspection through the door is quick and efficient. Once the tool is located, the user may then unlock the door and, using the handles, lifts the door off of the hanger plates. Thereafter, while the user continues to grip the handles the door is lowered to its open position (with the help of the pulley system) and the user removes the tool. The stop brackets limit the downward and rearward movement of the door. To close and secure the tool cabinet, the user merely grabs the handles and lifts the door (again with help from the pulley system) to the closed position where the guide pins of the upper most slat arrangement rest in the hanger plates, and the lock system reengages with the door, the utility drawer and the stacked locking blocks.

Figure 25:
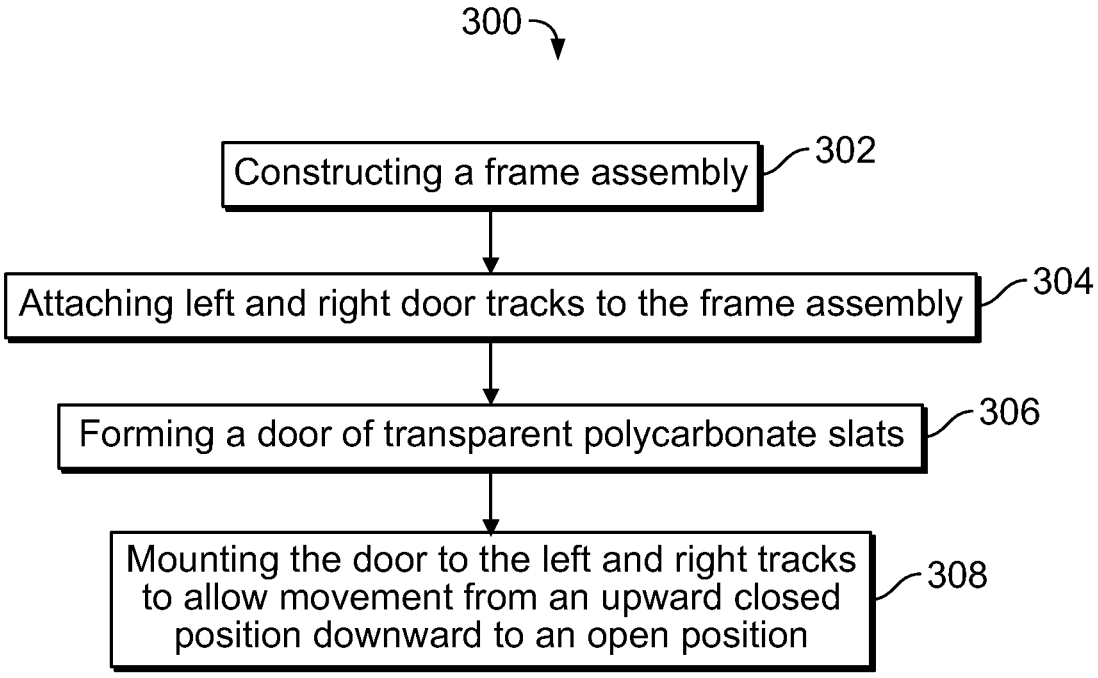
FIG. 25 is a flow chart of a method for assembling a press brake tool cabinet with a transparent downward opening front door.

The present invention also includes a method 300, FIG. 25, for assembling a tool cabinet having a transparent, downward opening front door, the method including the steps of constructing a frame assembly 302, attaching left and right door tracks to the frame assembly 304, forming a door of transparent polycarbonate slats 306, mounting the door to the left and right tracks to allow movement from an upward closed position downward to an open position 308. The method may also include the steps of mounting a plurality of drawers behind the door, attaching the door track systems to curve around the bottom end and up the rear of the frame assembly, and mounting stops to define the lower open position of the door.

It may now be understood that the press tool cabinet 10 is of relatively simple and robust construction that is relatively easy to manufacture and assemble. The cabinet is easy to use, offering the see-through door that allows quick, easy and efficient selection of press brake tools stored in the cabinet. Operating the cabinet door is also simple and easy, especially with the balancing pulley systems. The placement of an internal light facilitates tool selection and may give the cabinet a pleasing and high tech appearance.

From the foregoing, it can be seen that there has been provided features for an improved press brake tool cabinet with a transparent door that opens downward as well as a disclosure for the method for assembling the tool cabinet with the door. While particular embodiments of the present invention have been shown and described in detail, it will be obvious to those skilled in the art that changes and modifications may be made without departing from the invention in its broader aspects. Therefore, the aim is to cover all such changes and modifications as fall within the true spirit and scope of the invention. The matters set forth in the foregoing description and accompanying drawings are offered by way of illustrations only and not as limitations. The actual scope of the invention is to be defined by the subsequent patent claims when viewed in their proper perspective based on the prior art.

What is claimed is:

1. A press brake tool cabinet comprising:

a frame assembly, the frame assembly including two front and two rear posts mounted between a bottom panel and an upper panel;

a plurality of extendable drawers mounted to the front and rear posts;

left and right side panels mounted to the front and rear posts and a rear panel mounted to the rear posts;

left and right track systems mounted in front of the front posts and extending to the rear posts, each of the left and right track systems includes a front generally vertical portion, the vertical portion including a C-shaped cross section, a generally horizontal portion including a C-shaped cross section, a first curved portion between the front vertical and horizontal portions, a rear generally vertical portion, and a second curved portion between the horizontal and rear vertical portions, and the first and second curved portions, the horizontal portion and the rear vertical portion are formed in a single plate; and a door mounted to the left and right track systems in front of the drawers, the door being movable between an upper closed position and a lowered open position, wherein the door includes a plurality of transparent slats, each transparent slat mounted to a pair of upper and lower slat frames that minimally interfere with sight through the transparent slat, and each slat frame including a C-shaped mid portion and oppositely located end flanges.

2. The press brake tool cabinet as claimed in claim 1, including:

a hanger plate for supporting and retaining the door in the upper closed position mounted to the top of the front vertical portion of each track system.

3. The press brake tool cabinet as claimed in claim 1, including:

a right angled door stop plate to define the lowered position of the door connected to the single plate of each track system at the rear vertical portion.

4. The press brake tool cabinet as claimed in claim 1, including:

a pulley system mounted to the cabinet for facilitating movement of the door, the pulley system including a constant torque spring motor assembly.

5. The press brake tool cabinet as claimed in claim 1, wherein:

each slat frame of the pair of the upper and lower slat frames is identical to the other slat frame of the pair of upper and lower slat frames.

6. The press brake tool cabinet as claimed in claim 5, including:

a hinge bracket connecting the end flanges at each end of each pair of upper and lower slat frames, the hinge bracket including a guide pin for mounting in one of the track systems.

7. The press brake tool cabinet as claimed in claim 6, wherein:

the hinge bracket includes a bar with two openings for aligning with openings in the end flanges of a pair of upper and lower slat frames.

8. The press brake tool cabinet as claimed in claim 1, including:

a right angled stop plate connected to the single plate of each track system at the rear vertical portion.

9. The press brake tool cabinet as claimed in claim 1, including:

an upper drawer mounted to the front and rear posts above the upper panel and below a top panel.

10. The press brake tool cabinet as claimed in claim 9, including:

a three way lock system for maintaining the door in the upper closed position, the upper drawer in a closed position and each of the plurality of drawers in closed positions.

11. A press brake tool cabinet comprising:

a cabinet with a frame assembly, a plurality of extendable drawers mounted to the frame assembly, two side panels mounted to the frame assembly and a rear panel mounted to the frame assembly;

left and right tracks mounted in front of, beneath and behind the drawers; and a door formed of a plurality of transparent slats mounted to the left and right tracks, the door being movable between an upper closed position and a lowered open position wherein each slat is mounted to a pair of identical upper and lower slat frames that minimally interfere with sight through the transparent slat, and each slat frame includes a C-shaped mid portion and oppositely located end flanges, the end flanges at each end of each pair of upper and lower slat frames being connected by a hinge bracket having a guide pin mountable in one of the track systems.

12. The press brake tool cabinet as claimed in claim 11, wherein:

the frame assembly includes two front and two rear posts mounted between a bottom panel and an upper panel;

the plurality of drawers are mounted to the front and rear posts;

the left and right track systems are mounted in front of the front posts and extend to the rear posts, wherein each of the left and right track systems include a front generally vertical portion, the vertical portion including a C-shaped cross section, a generally horizontal portion including a C-shaped cross section, a first curved portion between the front vertical and horizontal portions, a rear generally vertical portion, and a second curved portion between the horizontal and rear vertical portions, and the first and second curved portions, the horizontal portion and the rear vertical portion are formed in a single plate; and including left and right side panels mounted to the front and rear posts and a rear panel mounted to the rear posts;

a hanger plate for supporting and retaining the door in the upper closed position mounted to the top of the front vertical portion of each track system;

a right angled door stop plate to define the lowered position of the door connected to the single plate of each track system at the rear vertical portion; and an upper drawer mounted to the front and rear posts above the upper panel and below a top panel.

13. A method for assembling a press brake tool cabinet comprising the steps of:

constructing a frame assembly having two front and two rear posts, an upper panel and a bottom panel;

mounting a plurality of drawers mounted to the front and rear posts;

attaching left and right door track systems in front of the front posts and to the rear posts;

forming a cabinet door of a plurality of transparent slats, each transparent slat mounted to a pair of identical upper and lower slat frames that minimally interfere with sight through the transparent slat; and mounting the cabinet door to the left and right track systems to allow movement of the cabinet door between an upward closed position and a downward open position.

14. The method as claimed in claim 13, including the step of:

connecting end flanges at each end of each pair of upper and lower slat frames with a hinge bracket, the hinge bracket including a guide pin for mounting in one of the track systems.

* * * * *